US010341765B2

(12) United States Patent
Goshen et al.

(10) Patent No.: US 10,341,765 B2
(45) **Date of Patent: *Jul. 2, 2019**

(54) SYSTEM AND METHOD FOR PROCESSING SOUND BEAMS

(71) Applicant: InSoundz Ltd., Raanana (IL)

(72) Inventors: Tomer Goshen, Tel Aviv (IL); Emil Winebrand, Petach Tikva (IL)

(73) Assignee: InSoundz Ltd., Raanana (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/718,518

(22) Filed: Sep. 28, 2017

(65) Prior Publication Data

US 2018/0020287 A1 Jan. 18, 2018

Related U.S. Application Data

(63) Continuation of application No. 14/693,055, filed on Apr. 22, 2015, now Pat. No. 9,788,108, which is a continuation of application No. PCT/IL2013/050853, filed on Oct. 22, 2013.

(60) Provisional application No. 61/716,650, filed on Oct. 22, 2012.

(51) Int. Cl.
*H04R 3/00* (2006.01)

(52) U.S. Cl.
CPC ..... *H04R 3/005* (2013.01); *H04R 2201/401* (2013.01); *H04R 2203/12* (2013.01); *H04R 2430/25* (2013.01)

(58) Field of Classification Search
CPC ..... H04R 3/005; H04R 2201/401; H04R 2203/12; H04R 2430/25
See application file for complete search history.

(56) References Cited

U.S. PATENT DOCUMENTS

| | | | | |
|---|---|---|---|---|
| 6,954,535 | B1 * | 10/2005 | Arndt | H04R 25/70 367/118 |
| 7,464,029 | B2 | 12/2008 | Visser et al. | |
| 8,542,855 | B2 * | 9/2013 | Elmedyb | H04R 25/552 381/23.1 |
| 9,215,527 | B1 | 12/2015 | Saric et al. | |
| 9,788,108 | B2 * | 10/2017 | Goshen | H04R 3/005 |
| 2007/0025562 | A1 * | 2/2007 | Zalewski | H04R 3/005 381/92 |

(Continued)

OTHER PUBLICATIONS

Patent Cooperation Treaty International Search Report for PCT/IL2013/050853, Israel Patent Office, Jerusalem, Israel, dated Feb. 20, 2014.

*Primary Examiner* — Andrew L Sniezek
(74) *Attorney, Agent, or Firm* — M&B IP Analysts, LLC

(57) ABSTRACT

A system and method for processing sounds. The sound processing system includes a sound sensing unit including a plurality of microphones, wherein each microphone is configured to capture non-manipulated sound signals; a beam synthesizer including a plurality of first modules, each first module corresponding to one of the plurality of microphones, wherein each first module is configured to filter the non-manipulated sound signals captured by the corresponding microphone to generate filtered sound signals; and a sound analyzer communicatively connected to the sound sensing unit and to the beam synthesizer, wherein the sound analyzer is configured to generate a manipulated sound beam based on the filtered sound signals.

17 Claims, 11 Drawing Sheets

(56) References Cited

U.S. PATENT DOCUMENTS

| | | | |
|---|---|---|---|
| 2008/0159559 | A1 | 7/2008 | Akagi et al. |
| 2010/0322436 | A1 | 12/2010 | Feng et al. |
| 2011/0286609 | A1 | 11/2011 | Faller |
| 2012/0128160 | A1 | 5/2012 | Kim et al. |

* cited by examiner

SYSTEM AND METHOD FOR PROCESSING SOUND BEAMS

CROSS REFERENCE TO RELATED APPLICATIONS

This application is a continuation of U.S. patent application Ser. No. 14/693,055 filed on Apr. 22, 2015, now allowed, which is a continuation of International Application No. PCT/IL2013/050853 filed on Oct. 22, 2013, which claims the benefit of U.S. Provisional Patent Application No. 61/716,650 filed on Oct. 22, 2012. The contents of the above-referenced Applications are hereby incorporated by reference.

TECHNICAL FIELD

The present disclosure relates generally to sound capturing systems and, more specifically, to systems for capturing sounds using a plurality of microphones.

BACKGROUND

While viewing a show or other video-recorded event, whether by television or by a computer device, many users find the audio experience to be highly important. This importance becomes increasingly significant when the show includes multiple sub-events occurring concurrently. For example, while viewing a sporting event, many viewers would highly appreciate the ability to listen to a conversation between the players, the instructions given by the coach, an exchange of words between a player and an umpire, and similar verbal communications simultaneously.

The problem with fulfilling such a requirement is that currently used sound capturing devices, i.e., microphones, are unable to practically adjust to the dynamic and intensive environment of, for example, a sporting event. In fact, currently used microphones are barely capable of tracking a single player or coach as that person runs or otherwise moves. Commonly, a large microphone boom is used to move the microphone around in an attempt to capture the sound. This issue is becoming significantly more notable due to the advent of high-definition (HD) television that provides high-quality images on the screen with disproportionately low sound quality.

In light of the shortcomings of prior art approaches, it would be advantageous to provide an efficient solution for enhancing the quality of sound captured during televised events.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" may be used herein to refer to a single embodiment or multiple embodiments of the disclosure.

Certain disclosed embodiments include a sound processing system. The sound processing system comprises a sound sensing unit including a plurality of microphones, wherein each microphone is configured to capture non-manipulated sound signals; a beam synthesizer including a plurality of first modules, each first module corresponding to one of the plurality of microphones, wherein each first module is configured to filter the non-manipulated sound signals captured by the corresponding microphone to generate filtered sound signals; and a sound analyzer communicatively connected to the sound sensing unit and to the beam synthesizer, wherein the sound analyzer is configured to generate a manipulated sound beam based on the filtered sound signals.

Certain disclosed embodiments also include a non-transitory computer readable medium having stored thereon instructions that, when executed by at least one processing circuitry, configure the at least one processing circuitry to perform a process, the process comprising: generating a plurality of filtered sound signals based on a plurality of non-manipulated sound signals and a plurality of filters operating in the audio frequency range, wherein the plurality of non-manipulated sounds signals is captured by a plurality of microphones, wherein the plurality of filters is generated by a plurality of first modules, each first module corresponding to one of the plurality of microphones; and generating a manipulated sound beam based on the plurality of filtered sound signals.

Certain disclosed embodiments include a method for processing sounds. The method comprises

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1:
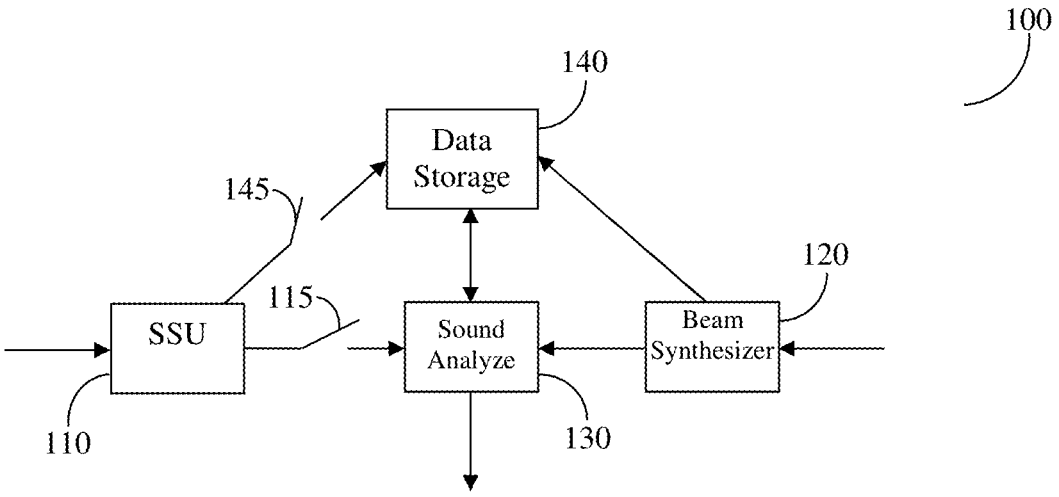
FIG. 1 is a block diagram of a system according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

Certain exemplary embodiments disclosed herein include a system that is configured to capture audio in the confinement of a predetermined sound beam. In an exemplary embodiment, the system comprises an array of microphones that capture a plurality of sound signals within one or more sound beams. The system is therefore configured to mute, eliminate, or reduce the side lobe sounds in order to isolate audio of a desired sound beam. The system may be tuned to allow a user to isolate a specific area of the sound beam using a beam forming technique. In an embodiment, the pattern of each sound beam can be fully manipulated. It should be noted that the audio range may refer to the human audio range as well as to other audio range such as, for example, sub human audio ranges.

FIG. 1 depicts an exemplary and non-limiting block diagram of a sound processing system 100 constructed according to one embodiment. A sound sensing unit (SSU) 110 includes a plurality of microphones configured to capture a plurality of sound signals from a plurality of non-manipulated sound beams. A sound beam defines a directional (angular) dependence of the gain of a received spatial sound wave. A beam synthesizer 120 is configured to receive, at least, sound beam metadata. The sound beam metadata and the plurality of sound signals are transferred to a sound analyzer 130 that is configured to generate a manipulated sound beam in response to the transfer.

In one embodiment, the sound processing system 100 may further include storage in the form of a data storage unit 140 or a database (not shown) for storing, for example, one or more definitions of sound beams, metadata, information from filters, raw data (e.g., sound signals), and/or other information captured by the sound sensing unit 110. The filters are circuits working in the audio frequency range and are used to process the raw data captured by the sound sensing unit 110. The filters may be preconfigured, or may be dynamically adjusted with respect to the received metadata.

In various embodiments, one or more of the sound sensing unit 110, the sound analyzer 120, and the beam synthesizer 130 may be coupled to the data storage unit 140. In another embodiment, the sound processing system 100 may further include a control unit (not shown) connected to the beam synthesizer unit 120. The control unit may further include a user interface that allows a user to capture or manipulate any sound beam.

In some implementations, the sound processing system 100 may include a switch configured to provide of sound signals to the sound analyzer 120 from the sound sensing unit 110, the database 140, or both.

Figure 2:
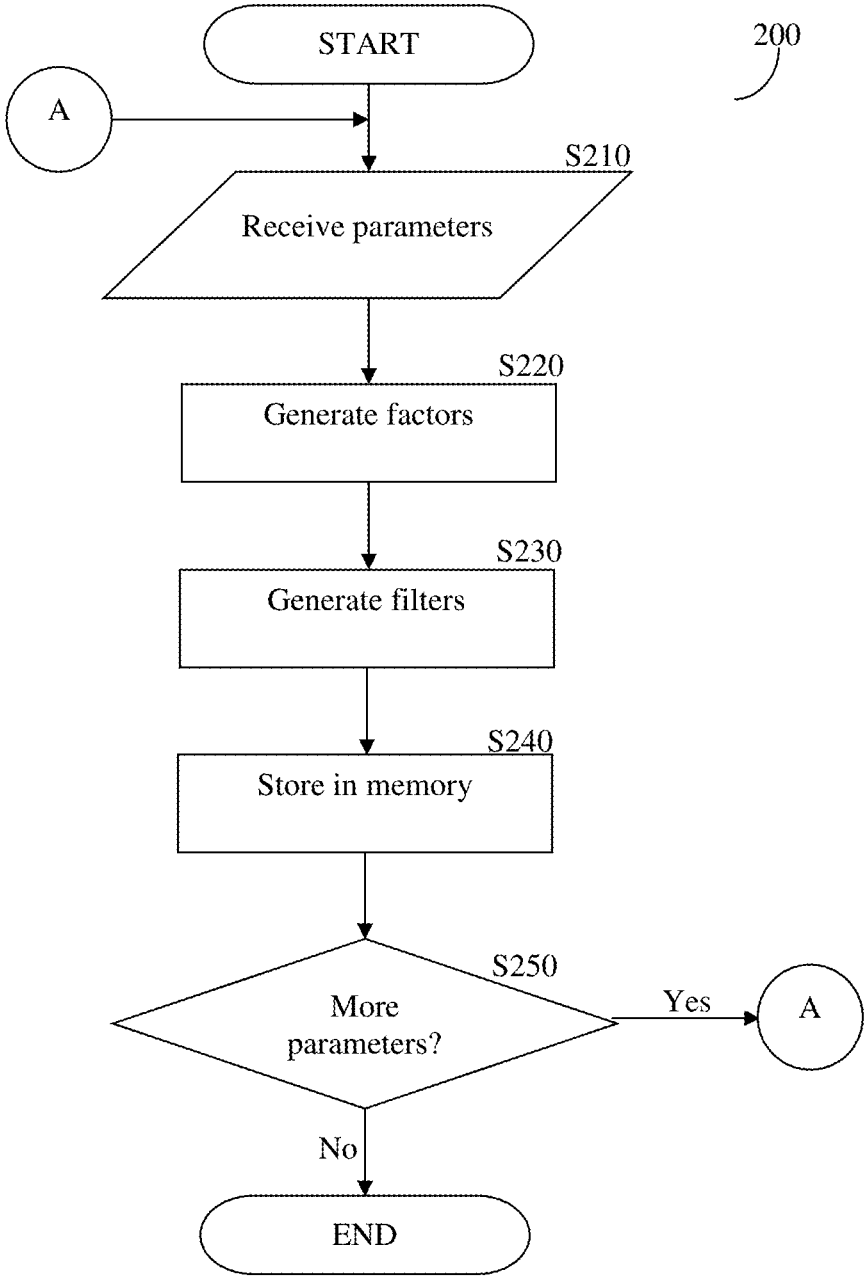
FIG. 2 is a flowchart illustrating a method for capturing sound signals according to one embodiment.

FIG. 2 is an exemplary and non-limiting flowchart 200 illustrating a method for capturing sound signals according to one embodiment. In an embodiment, the sound signals may be captured by the sound processing system 100.

In S210, one or more parameters of one or more sound beams are received. Such parameters may be, but are not limited to, a selection of one or more sound beams, a pattern of the one or more sound beams, modifications concerning the one or more sound beams, and so on. According to one embodiment, the pattern of the one or more sound beams may be dynamically adaptive to, for example, a noise environment.

In S220, one or more weighted factors are generated. According to one embodiment, the weighted factors are generated by a generalized side lobe canceller (GSC) algorithm. According to this embodiment, it is presumed that the direction of the sources from which the sounds are received, the direction of the desired signal, and the magnitudes of those sources are known. The weighted factors are generated by determining a unit gain in the direction of the desired signal source while minimizing the overall root mean square (RMS) noise power.

According to another embodiment, the weighted factors are generated by an adaptive method in which the noise strength impinging each microphone and the noise correlation between the microphones are tracked. In this embodiment, the direction of the desired signal source is received as an input. Based on the received parameters, the expectancy of the output noise is minimized while maintaining a unity gain in the direction of the desired signal. This process is performed separately for each sound interval.

In S230 a plurality of filters is generated, with each filter corresponding to one of the parameters. As noted above, the filters are circuits working in the audio frequency range and are used to process raw data related to the one or more sound beams. The filters may be preconfigured, or may be dynamically adjusted with respect to the received metadata.

In S240, the weighted factors are stored in a database (e.g., the storage unit 140) and the filters are stored in a database (e.g., the storage unit 140). In an embodiment, the same database may be used for storing both the factors and the filters.

In S250, the system checks whether additional parameters are to be received and, if so, execution continues with S210; otherwise, execution terminates. A plurality of filters utilized in conjunction with the received parameters and applied to a non-manipulated sound beam results in a definition of a manipulated sound beam. Thus, one manipulated sound beam may be different from another manipulated sound beam based on the construction of the respective filters used to define those sound beams.

Figure 3:
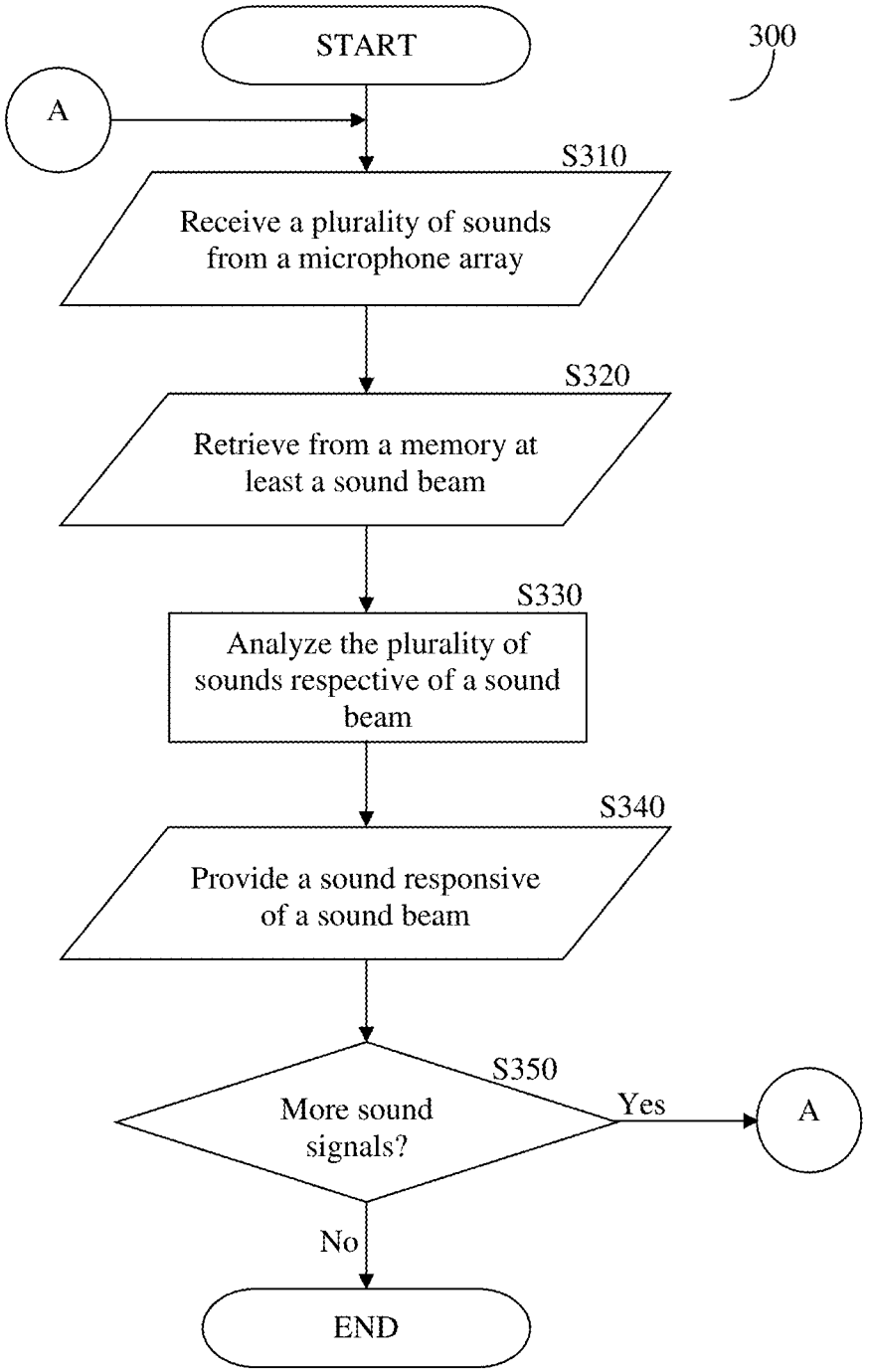
FIG. 3 is a flowchart illustrating processing sound signals retrieved, in part or in whole, from a storage unit according to another embodiment.

FIG. 3 is an exemplary and non-limiting flowchart 300 illustrating processing sound signals retrieved, in part or in whole, from a storage unit according to an embodiment. In S310, a plurality of sound signals is received from a microphone array via, for example, the sound sensing unit 110. In an embodiment, the plurality of sounds may be retrieved from a storage unit. This retrieval allows a user to manipulate sound in an offline mode (as a non-limiting example, while the sound sensing unit 110 is not in use) rather than solely being able to manipulate sound in real-time, i.e., when the signals are captured. Hence, in an embodiment, a user may manipulate the input of sound via a switch. Furthermore, in another embodiment, sound signals may be partially provided from a sound sensing unit (e.g., the sound sensing unit 110) and partially from the data storage unit (e.g., the data storage unit 140).

In S320, at least one sound beam is retrieved from the storage unit 140.

In S330, the plurality of received and/or captured sound signals are analyzed with respect to the at least one sound beam. In an embodiment, the analysis is performed in a time domain. According to this embodiment, an extracted filter is applied to each sound signal. In an embodiment, the filter may be applied by a synthesis unit. The filtered signals may be summed to a single signal by, e.g., the synthesis unit (e.g., the beam synthesizer 120).

In another embodiment, the analysis is performed in the frequency domain in which the received sound signal is first segmented. In that embodiment, each of the segments is transformed by, for example, a one-dimensional fast Fourier transform (FFT) or any other wavelet decomposition transformation. The transformed segments are multiplied by the weighted factors. The output is summed for each decomposition element and transformed by an inverse one-dimensional fast Fourier transform (IFFT) or any other wavelet reconstruction transformation.

In S340, at least one analyzed sound signal responsive of the at least one sound beam is provided.

In S350, it is checked whether additional sound signals have been received and, if so, execution continues with S310; otherwise, execution terminates.

Figure 4:
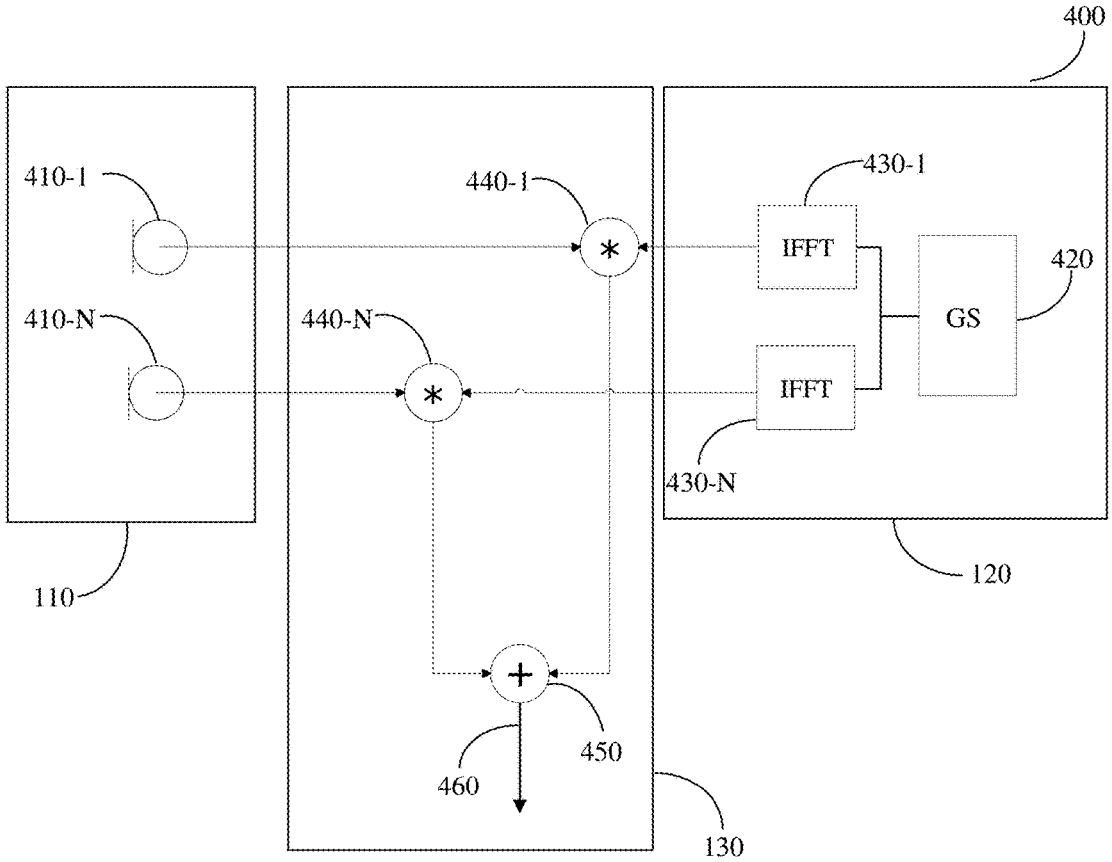
FIG. 4 is a block diagram of a microphone array according to an embodiment.

FIG. 4 is an exemplary and non-limiting block diagram of a sound processing system 400 according to the embodiment shown in FIG. 1. The SSU 110 includes a plurality of microphones 410-1 through 410-N (hereinafter referred to individually as a microphone 410 and collectively as microphones 410, merely for simplicity purposes) for capturing sound signals. A module 420 within the beam synthesizer 120 is configured to receive a plurality of constraints. The module 420 may be configured by a generalized side lobe canceller (GSC) algorithm. The operation of the GSC algorithm is discussed in further detail herein above.

The module 420 is configured to generate one weighted factor per frequency (with one or more frequencies), and to supply the factor to a plurality of modules 430-1 through 430-N (hereinafter referred to individually as a module 430 and collectively as modules 430, merely for simplicity purposes). Each module 430 corresponds to a microphone 410 and is configured to generate one of a plurality of filters 440-1 through 440-N (hereinafter referred to individually as a filter 440 and collectively as filters 440, merely for simplicity purposes). In an embodiment, one filter 440 is generated for each sound signal 410. In the embodiment shown in FIG. 4, the filters 440 are generated by using, for example, an inverse one-dimensional fast Fourier transform (IFFT) algorithm.

The modules 430 apply the plurality of filters 440 to the sounds captured by microphones 410. The filtered sounds are transferred to a module 450, in the sound analyzer 130, configured to add the filtered sounds. The module 450 is configured to generate a sound beam 460 based on the sum of the manipulated sounds.

Figure 5:
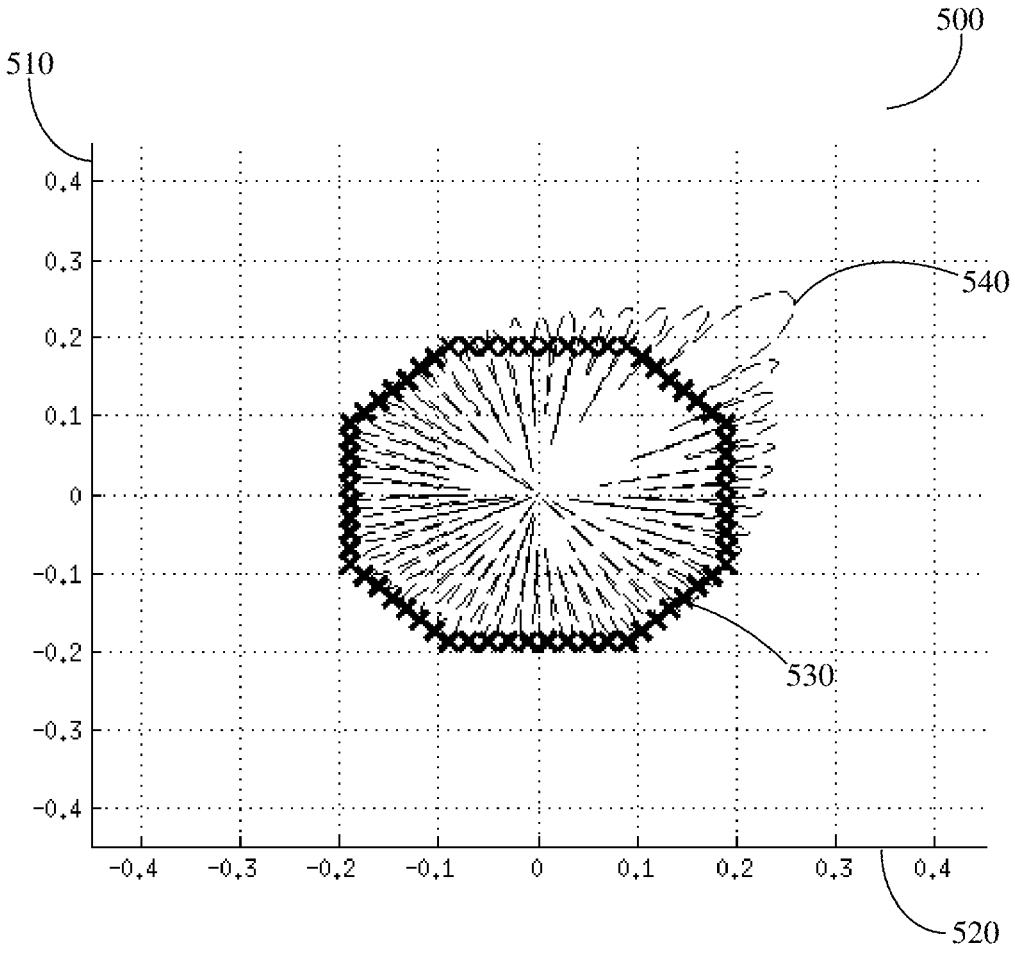
FIG. 5 is a matrix illustrating a sound beam and a microphone array according to an embodiment.

FIG. 5 is an exemplary and non-limiting matrix 500 illustrating a simulation of a single sound beam and a microphone array according to one embodiment. The X axis 510 of the matrix 500 is a Cartesian axis representing the X axis of the beam. The Y axis 510 of the matrix 500 represents the Cartesian Y axis of the beam. In the embodiment shown in FIG. 5, microphones of a microphone array 530 associated with a sound sensing unit (e.g., the sound sensing unit 110) are arranged in an octagonal shape in order to achieve an appropriate coverage of the plurality of sound beams 540.

In another embodiment, the microphones in the microphone array 530 may be positioned or otherwise arranged in a variety of polygons in order to achieve an appropriate coverage of the plurality of sound beams 540. In yet another embodiment, the microphones in the microphone array 530 are arranged on curved lines. Furthermore, the microphones in the microphone array 530 may be arranged in a three-dimensional shape, for example on a three-dimensional sphere or a three-dimensional object formed of a plurality of hexagons.

It should be noted that the sound processing system 100 may include a plurality of microphone arrays positioned or otherwise arranged at a predetermined distance from each other to achieve an appropriate coverage of the plurality of sound beams. For example, two microphone arrays can be positioned under the respective baskets of opposing teams in a basketball court.

Figure 6:
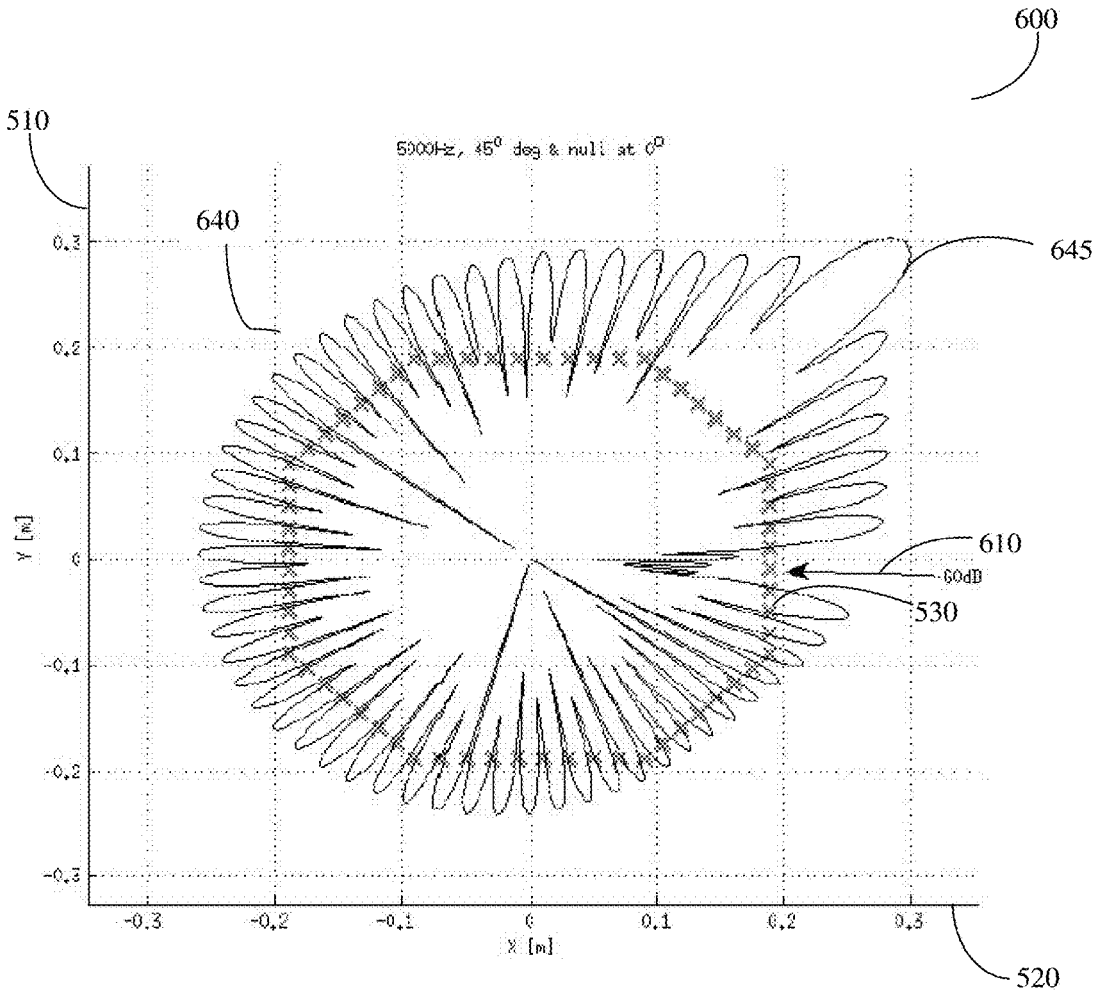
FIG. 6 is a matrix illustrating the muting of undesired side lobes according to an embodiment.

FIG. 6 is an exemplary and non-limiting matrix 600 illustrating the muting of a side lobe according to an embodiment. Similar to the matrix of FIG. 5, matrix 600 includes the microphone array 530 arranged in an octagonal pattern with respect to the Cartesian X-axis 520 and the Cartesian Y-axis 510. In order to isolate one or more sound beams from a plurality of sound beams 640, the user can mute one or more side lobes respective of the sound beams by means of a user interface (not shown). For example, by manipulating the sound beam from a microphone positioned at a direction 610, a sound beam located in that direction from the center of the microphone array is reduced by 60 dB (decibels). Consequently, other sound beams may be enhanced. In the example shown in FIG. 6, a main lobe 645 is in a direction of a desired sound beam. Muting the side lobe associated with the microphone in the direction 610 affects the main lobe 645, thereby enhancing the sound beam associated with the main lobe 645.

Figure 7:
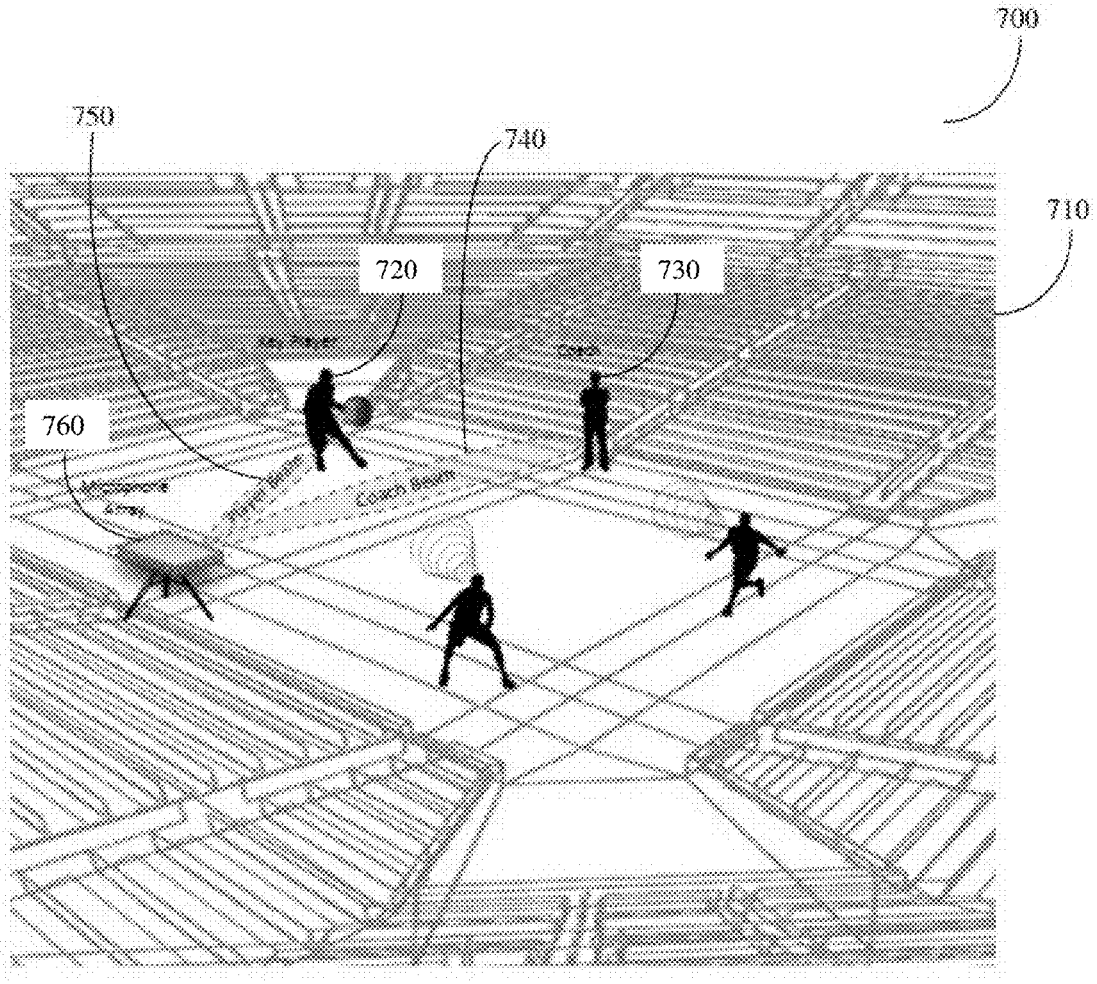
FIG. 7 is a simulation of a plurality of sound beams captured during a basketball game according to an embodiment.

FIG. 7 is an exemplary and non-limiting simulation 700 of a plurality of sound beams captured during a basketball game according to an embodiment. A microphone array such as microphone array 760 is positioned within the space of a basketball hall 710. A plurality of sound signals within a plurality of sound beams are generated during a basketball game by, for example, a player holding the ball (the "key player") 720, and a coach 730.

In order to capture the voices (sound signals) produced by the coach 730, the microphone array 760 is configured to mute sounds that are generated by the side lobes, thereby isolating the specific sound generated by the coach 730. This creates a sound beam 740, which allows the user to capture voices only existing within the sound beam itself, preferably with emphasis on the voice of the coach 730. In order to capture a specific sound generated by the key player 720, the microphone array 760 is configured to mute sounds that are generated by the side lobes, thereby isolating the specific sound generated by the key player 720 creating a sound beam 750 that allows the user to capture voices only existing within the sound beam 750 itself, preferably with emphasis on those sounds produced by the key player 750. In one embodiment, the system is capable of identifying nearby sources of noise such as sounds produced by the spectators, and of muting such sources.

Figure 8A:
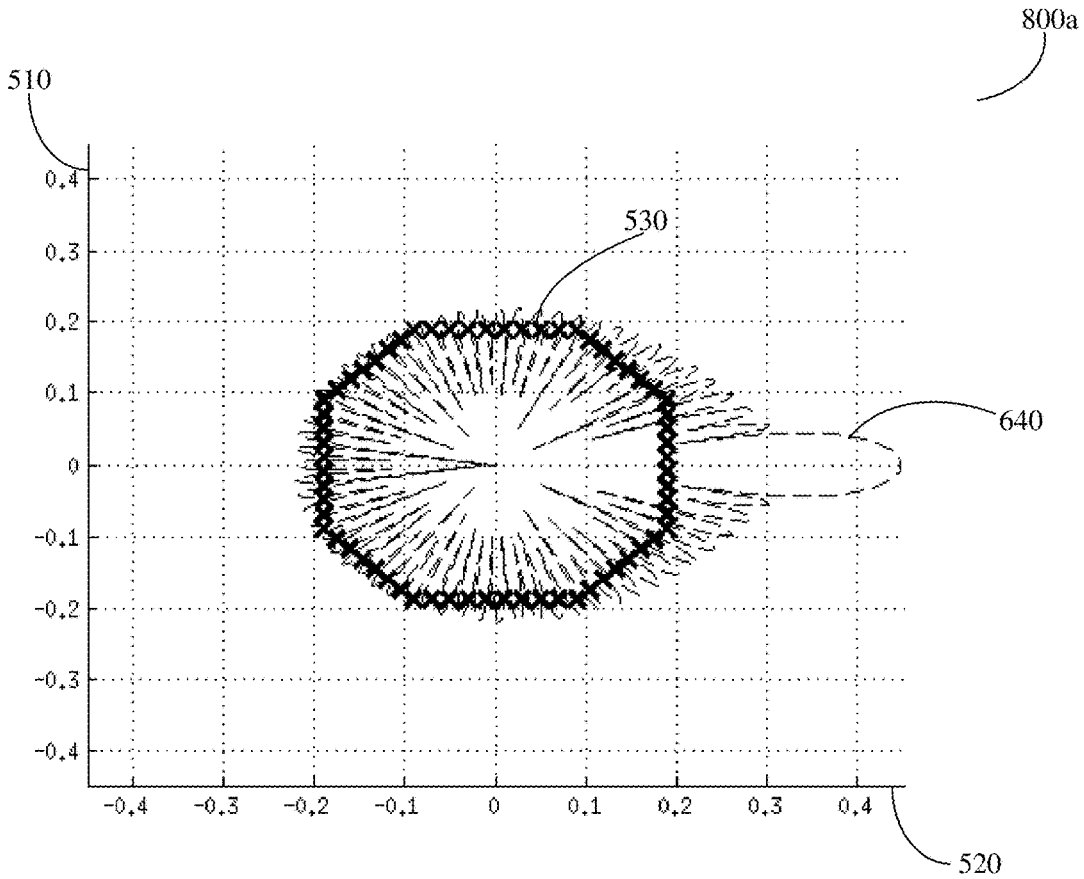
FIG. 8*a* is a matrix illustrating a wide main lobe in 0 degrees and a microphone array according to an embodiment.

FIG. 8A is an exemplary and non-limiting matrix 800*a* illustrating a simulation of a wide sound beam 640 at 0 degrees with respect to the point (0,0) and the microphone array 530 according to an embodiment.

Figure 8B:
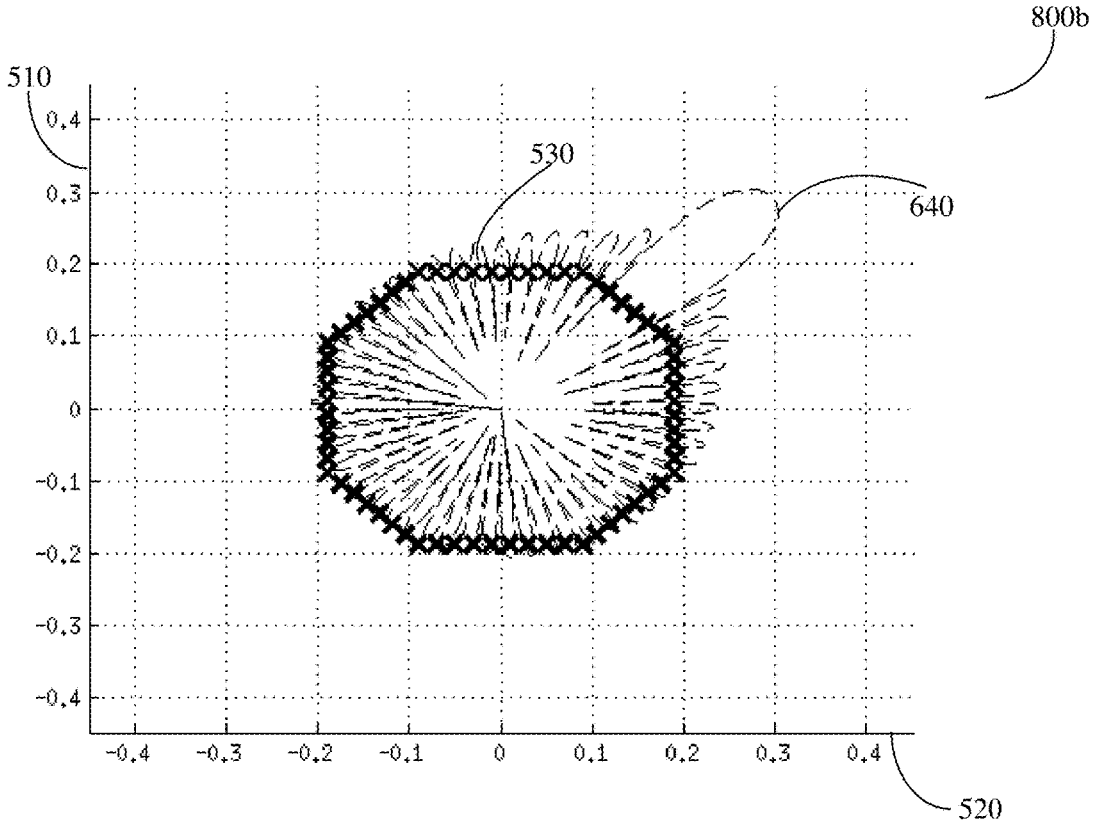
FIG. 8*b* is a matrix illustrating a wide main lobe in 45 degrees and a microphone array according to an embodiment.

FIG. 8B is an exemplary and non-limiting matrix 800*b* illustrating a simulation of a wide sound beam 640 at 45 degrees with respect to the point (0,0) and the microphone array 530 according to an embodiment.

Figure 9A:
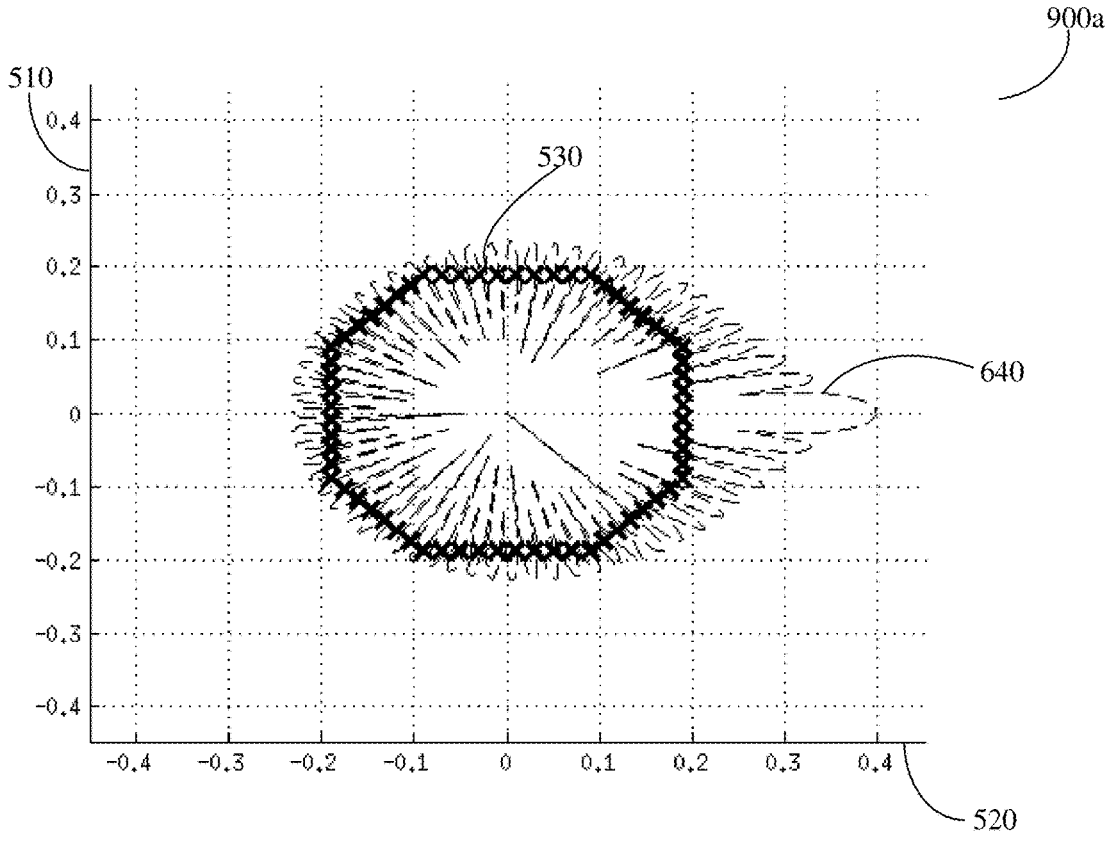
FIG. 9*a* is a matrix illustrating a narrow main lobe in 0 degrees and a microphone array according to an embodiment.

FIG. 9*a* is an exemplary and non-limiting matrix 900*a* illustrating a simulation of a narrow sound beam 640 at 0 degrees with respect to the point (0,0) and the microphone array 530 according to an embodiment.

Figure 9B:
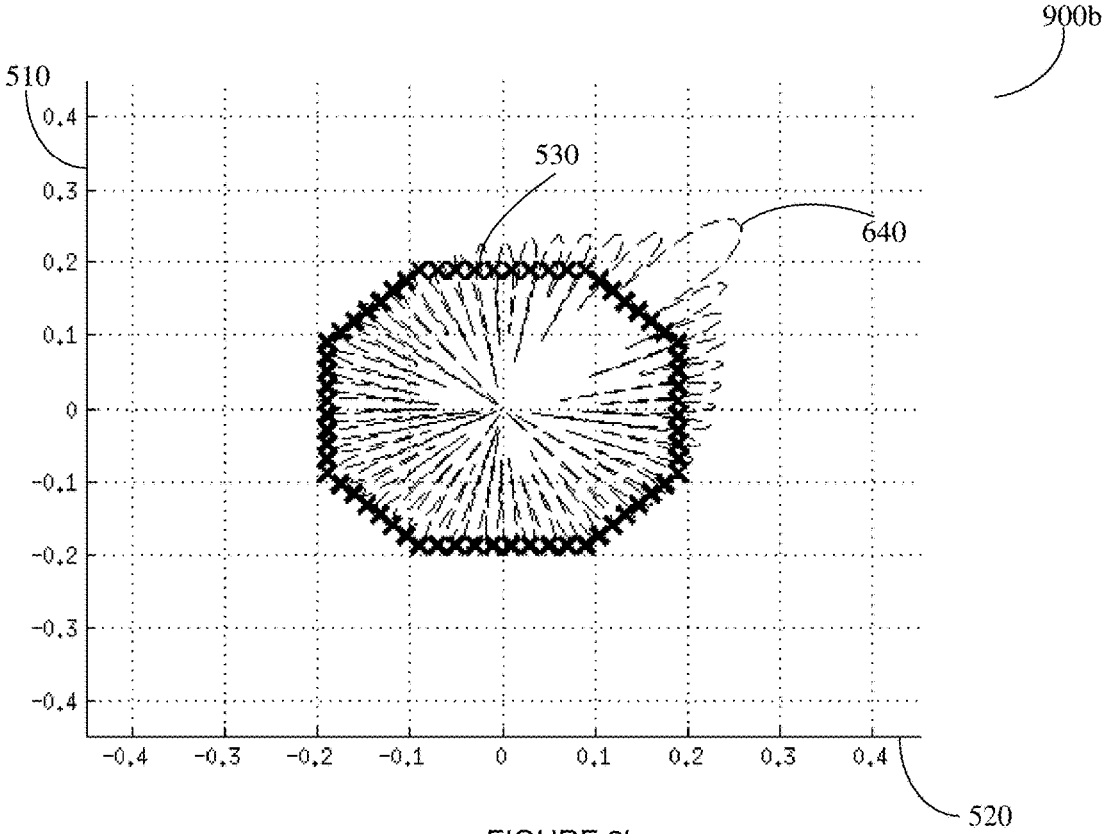
FIG. 9*b* is a matrix illustrating a narrow main lobe in 45 degrees and a microphone array according to an embodiment.

FIG. 9*b* is an exemplary and non-limiting matrix 900*b* illustrating a simulation of a narrow sound beam 640 at 45 degrees with respect to the point (0,0) and the microphone array 530 according to an embodiment.

The various embodiments disclosed herein can be implemented as hardware, firmware, software, or any combination thereof. Moreover, the software is preferably implemented as an application program tangibly embodied on a program storage unit or non-transitory computer readable medium consisting of parts, or of certain devices and/or a combination of devices. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, whether or not such a computer or processor is explicitly shown. In addition, various other peripheral units may be connected to the computer platform such as an additional data storage unit and a printing unit. Furthermore, a non-transitory computer readable medium is any computer readable medium except for a transitory propagating signal.

All examples and conditional language recited herein are intended for pedagogical purposes to aid the reader in understanding the principles of the disclosed embodiments and the concepts contributed by the inventor to furthering the art, and are to be construed as being without limitation to such specifically recited examples and conditions. Moreover, all statements herein reciting principles, aspects, and embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

A person skilled-in-the-art will readily note that other embodiments may be achieved without departing from the scope of the disclosure. All such embodiments are included herein. The scope of the disclosure should be limited solely by the claims thereto.

What is claimed is:

1. A sound processing system, comprising:

a sound sensing unit including a plurality of microphones, wherein each microphone is configured to capture non-manipulated sound signals, wherein at least a portion of the non-manipulated sound signals is stored in a database;

a beam synthesizer including a plurality of first modules, each first module corresponding to one of the plurality of microphones, wherein each first module is configured to filter the non-manipulated sound signals captured by the corresponding microphone to generate filtered sound signals;

a sound analyzer communicatively connected to the sound sensing unit to receive the captured non-manipulated sound signals and to the beam synthesizer, wherein the sound analyzer is configured to generate a manipulated sound beam based on the filtered sound signals; and a switch, wherein the switch is configured to provide sound signals to the sound analyzer from at least one of: the sound sensing unit, and the database.

2. The sound processing system of claim 1, wherein each first module is configured to generate a filter for one of the non-manipulated sound signals captured by the corresponding microphone, wherein generating the filtered sound signals includes applying the filters generated by the plurality of first modules to the non-manipulated sound signals.

3. The sound processing system of claim 1, wherein the beam synthesizer further includes a second module, wherein the second module is configured to generate at least one weighted factor and to supply the at least one weighted factor to the plurality of first modules.

4. The sound processing system of claim 3, wherein the non-manipulated sound signals are filtered based on the at least one weighted factor.

5. The sound processing system of claim 1, wherein the filtering is performed in the frequency domain.

6. The sound processing system of claim 1, further comprising:

a control unit connected to the beam synthesizer and configured to control an operation of the beam synthesizer.

7. The sound processing system of claim 1, wherein the switch is further configured to provide a first portion of sound from the sound sensing unit and a second portion of sound from the database.

8. The sound processing system of claim 1, wherein the database is further configured to store a definition of the manipulated sound beam.

9. The sound processing system of claim 1, wherein the beam synthesizer is further adapted to receive metadata; and wherein the sound analyzer is further configured to generate the manipulated sound beam also based on the received metadata.

10. A non-transitory computer readable medium having stored thereon instructions that, when executed by at least one processing circuitry, configure the at least one processing circuitry to perform a process, the process comprising:

generating a plurality of filtered sound signals based on a plurality of non-manipulated sound signals and a plurality of filters operating in the audio frequency range, wherein the plurality of non-manipulated sound signals is captured by a plurality of microphones, wherein the plurality of filters is generated by a plurality of first modules in a beam synthesizer, each first module corresponding to one of the plurality of microphones, wherein at least a portion of the non-manipulated sound signals is stored in a database; and generating a manipulated sound beam based on the plurality of filtered sound signals, wherein the manipulated sound beam is generated by a sound analyzer communicatively connected to receive the plurality of non-manipulated sound signals captured by the plurality of microphones and to the beam synthesizer, wherein the non-manipulated sound signals are received from a switch, wherein the switch is configured to provide sound signals from at least one of: the plurality of microphones, and the database.

11. A method for processing sounds, comprising:

generating a plurality of filtered sound signals based on a plurality of non-manipulated sound signals and a plurality of filters operating in the audio frequency range, wherein the plurality of non-manipulated sound signals is captured by a plurality of microphones, wherein the plurality of filters is generated by a plurality of first modules in a beam synthesizer, each first module corresponding to one of the plurality of microphones, wherein at least a portion of the non-manipulated sound signals is stored in a database; and generating a manipulated sound beam based on the plurality of filtered sound signals, wherein the manipulated sound beam is generated by a sound analyzer communicatively connected to receive the plurality of non-manipulated sound signals captured by the plurality of microphones and to the beam synthesizer, wherein the non-manipulated sound signals are received from a switch, wherein the switch is configured to provide sound signals from at least one of: the plurality of microphones, and the database.

12. The method of claim 11, wherein each first module is configured to generate a filter for one of the non-manipulated sound signals captured by the corresponding microphone, wherein generating the filtered sound signals further comprises:

applying the filters generated by the plurality of first modules to the non-manipulated sound signals.

13. The method of claim 11, wherein the plurality of first modules is configured to receive at least one weighted factor generated by a second module.

14. The method of claim 13, wherein the non-manipulated sound signals are filtered based on the at least one weighted factor.

15. The method of claim 11, wherein the filtering is performed in the frequency domain.

16. The method of claim 11, wherein the switch is further configured to provide a first portion of sound from the sound sensing unit and a second portion of sound from the database.

17. The method of claim 11, wherein the database is further configured to store a definition of the manipulated sound beam.

* * * * *